US007500511B2

(12) United States Patent
Connors et al.

(10) Patent No.: US 7,500,511 B2
(45) Date of Patent: Mar. 10, 2009

(54) MOLDING COMPOSITION AND METHOD OF USE

(75) Inventors: George Connors, Chicago, IL (US); Shirish Shah, Carol Stream, IL (US)

(73) Assignee: Magneco/Metrel, Inc., Addison, IL (US)

( * ) Notice: Subject to any disclaimer, the term of this patent is extended or adjusted under 35 U.S.C. 154(b) by 549 days.

(21) Appl. No.: 10/671,423

(22) Filed: Sep. 24, 2003

(65) Prior Publication Data

US 2005/0061471 A1 Mar. 24, 2005

(51) Int. Cl.
*B22C 1/02* (2006.01)
*B22C 9/04* (2006.01)
*B28B 7/34* (2006.01)

(52) U.S. Cl. ..... 164/519; 164/361; 106/38.3; 106/38.35

(58) Field of Classification Search ..... 164/516, 164/517, 518, 519, 361; 106/38.2, 38.3, 106/38.35
See application file for complete search history.

(56) References Cited

U.S. PATENT DOCUMENTS 3,758,317 A * 9/1973 Moore, Jr. et al. ..... 501/95.1
4,026,344 A * 5/1977 Greskovich ..... 164/519
4,093,470 A 6/1978 Cherry
4,131,475 A * 12/1978 Svec ..... 106/38.3
4,581,068 A * 4/1986 Schramm ..... 420/33
4,800,181 A 1/1989 Lassiter et al.
4,996,084 A 2/1991 Elkachouty
5,147,830 A * 9/1992 Banerjee et al. ..... 501/89
5,147,834 A 9/1992 Banerjee
5,155,070 A 10/1992 Skorupa
5,168,082 A 12/1992 Matchett et al.
5,214,006 A 5/1993 Langenohl
5,391,606 A * 2/1995 Doles ..... 524/430
5,418,198 A 5/1995 Connors, Sr. et al.
5,422,323 A 6/1995 Banerjee et al.
5,482,248 A * 1/1996 Connors, Jr. ..... 249/62
5,494,267 A 2/1996 Anderson et al.
5,629,369 A 5/1997 Guerra, Jr.
5,735,335 A 4/1998 Gilmore et al.
5,738,921 A * 4/1998 Andersen et al. ..... 428/36.4
5,824,730 A 10/1998 Guerra, Jr.
6,375,692 B1 * 4/2002 Manwiller et al. ..... 51/302
6,528,011 B2 3/2003 Connors, Sr. et al.
6,540,013 B1 4/2003 Doles
6,551,396 B1 4/2003 Pineda et al.
7,004,230 B2 * 2/2006 Vandermeer et al. ..... 164/519
2004/0083926 A1 * 5/2004 Mitkova et al. ..... 106/38.27

* cited by examiner

*Primary Examiner*—Kevin P Kerns
(74) *Attorney, Agent, or Firm*—Brinks Hofer Gilson & Lione

(57) ABSTRACT

A slurry composition for a mold and method of use thereof. The slurry composition includes about 45-80% by weight alumina, about 10-30% by weight silicon carbide, and about 10-50% by weight colloidal silica. In one aspect, the alumina component comprises a material selected from the group consisting of brown fused alumina, white fused alumina, tabular alumina, calcined alumina, and mixtures thereof. In another aspect, the composition includes fumed silica at 2-5% by weight. The composition may also include a setting agent at 0.05-2% by weight.

37 Claims, 3 Drawing Sheets

Fig. 1
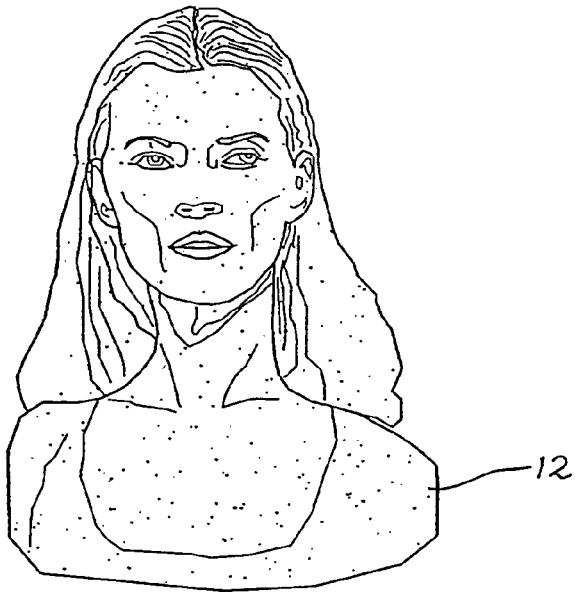
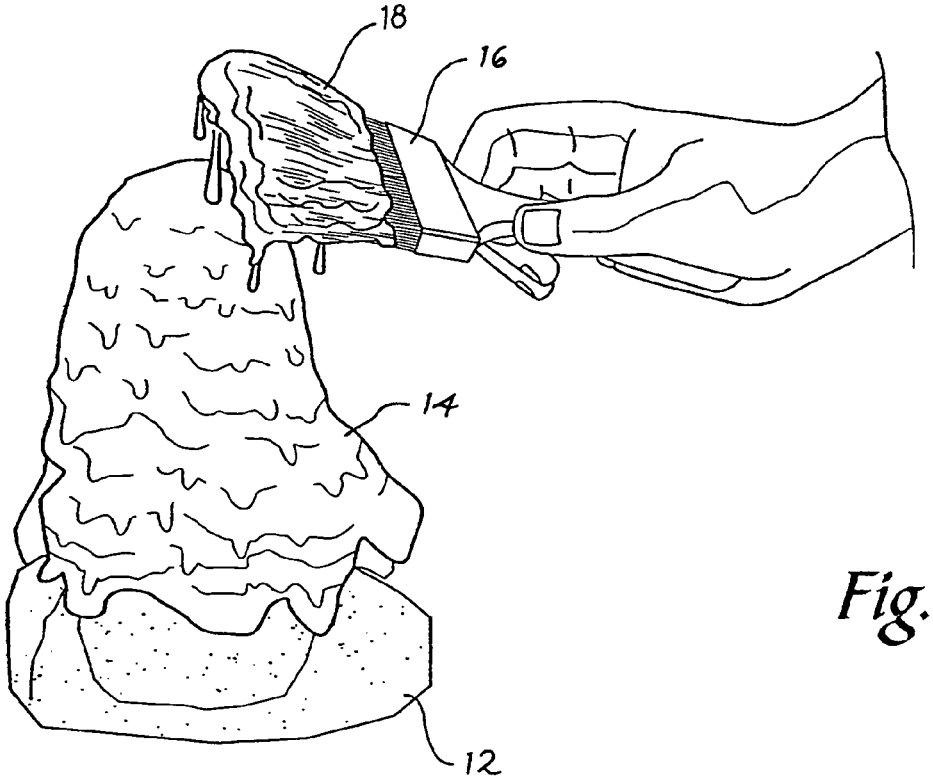
Fig. 2

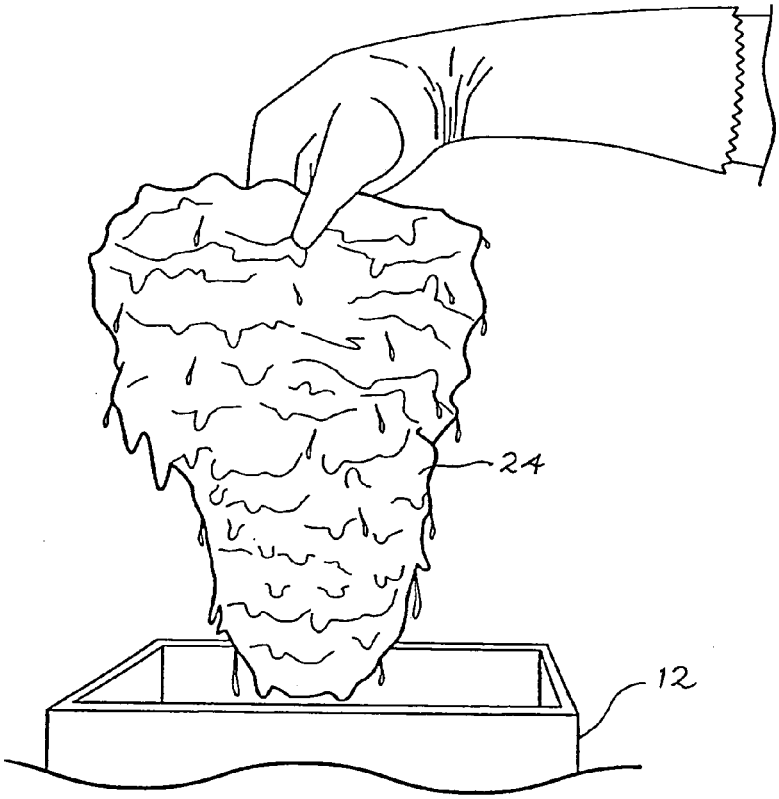
Fig. 4
Fig. 5
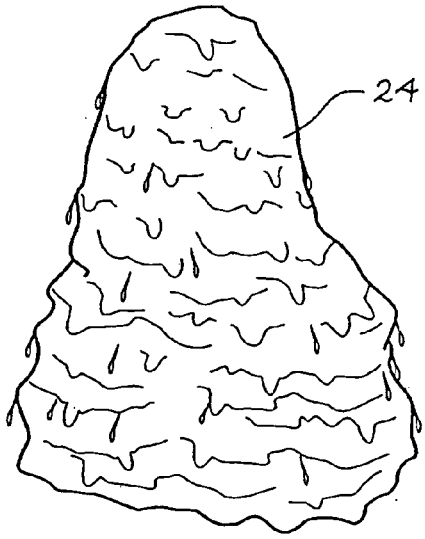

MOLDING COMPOSITION AND METHOD OF USE

BACKGROUND

Investment casting, also known as lost wax, lost pattern or precision casting, is a process employed in a number of industries to make metal, glass, and ceramic articles that meet relatively close dimensional tolerances. Typically, an investment casting is made by first making a facsimile or pattern from a meltable substrate of the object to be made by investment casting. Suitable meltable substrates may include, for example, wax, polystyrene, or plastic.

Next, a ceramic mold, known as an investment casting shell, is formed around the pattern. This process may include dipping the pattern into a slurry containing a mixture of liquid refractory binders and a refractory powder and then sieving dry refractory grains onto the freshly dipped pattern. The most commonly used dry refractory grains include quartz, fused silica, zircon, alumina and aluminosilicate. The steps of dipping the pattern into a refractory slurry and then sieving dry refractory grains onto the freshly dipped pattern may be repeated until the mold has sufficient thickness and strength for further processing. However, it is preferable if each coat of slurry and refractory grains is air-dried before subsequent coats are applied. The investment slurry is then given time to set and dry. Drying can be accelerated by forced air and other techniques.

After drying, the shell is heated to at least the melting point of the meltable substrate. The heat melts the substrate away, leaving only the shell and possibly some residual substrate. The shell may be heated to a temperature high enough to vaporize any residual meltable substrate from the shell. Generally, the shell is filled with molten metal before the shell has cooled from the high temperature heating. Various methods have been used to introduce molten metal into shells including gravity, pressure, vacuum and centrifugal methods. When the molten metal in the mold has solidified and cooled sufficiently, the casting may be removed from the shell.

Although investment casting has been known and used for many years, the investment casting market continues to grow as the demand for more intricate and complicated parts increase. Because of the great demand for high quality, precision castings, there continuously remains a need to develop new ways to make investment casting shells more quickly, efficiently, cheaply and of higher quality. For instance, if the strength of investment casting shells could be increased, less material would be required. If an investment casting shell could be made with fewer coatings, it could be made more quickly, resulting in time and cost savings.

BRIEF SUMMARY

The present invention is directed to slurry composition for a mold and method of use thereof. The composition includes about 45-80% by weight alumina, about 10-30% by weight silicon carbide, and about 10-50% by weight colloidal silica. In one aspect, the alumina component comprises a material selected from the group consisting of brown fused alumina, white fused alumina, tabular alumina, calcined alumina, and mixtures thereof. In another aspect, the composition includes fumed silica at 2-5% by weight. In another aspect, the composition includes a setting agent at 0.05-2% by weight.

The casting method includes the steps of providing a meltable patterned substrate, coating the substrate with a slurry composition, allowing the slurry composition to set, and removing the substrate from the mold. The slurry composition includes about 45-80% by weight alumina, about 10-30% by weight silicon carbide, and about 10-50% by weight colloidal silica. In one aspect, the method includes coating the substrate with the slurry composition by dipping the substrate into the slurry composition. In another aspect, the method includes coating the substrate with the slurry composition by spraying the slurry composition onto the substrate. In another aspect, the method includes coating the substrate with the slurry composition by brushing the slurry composition onto the substrate.

The composition of the present invention has several advantages. One is that the slurry can be applied in as few as one or two coatings, instead of the multiple coatings of conventional compositions for investment casting molds. Another advantage is that the set time can be controlled by varying the amount of setting agent. A further advantage is reducing the necessary finishing work because the shell sticks less to the cast piece. Other advantages include less material consumption, quicker turn around time, excellent thermal shock resistance, and very good detail in the final product.

The foregoing paragraphs have been provided by way of general introduction, and are not intended to limit the scope of the following claims. The presently preferred embodiments, together with further advantages, will be best understood by reference to the following detailed, description taken in conjunction with the accompanying drawings.

BRIEF DESCRIPTION OF THE DRAWINGS

FIG. 1 shows the design of a patterned substrate.

FIG. 2 shows a substrate being coated with the composition.

FIG. 4 shows the substrate being dipped into the composition.

FIG. 5 shows the substrate coated with the composition.

DETAILED DESCRIPTION OF THE DRAWINGS AND THE PRESENTLY PREFERRED EMBODIMENTS

Figure 3:
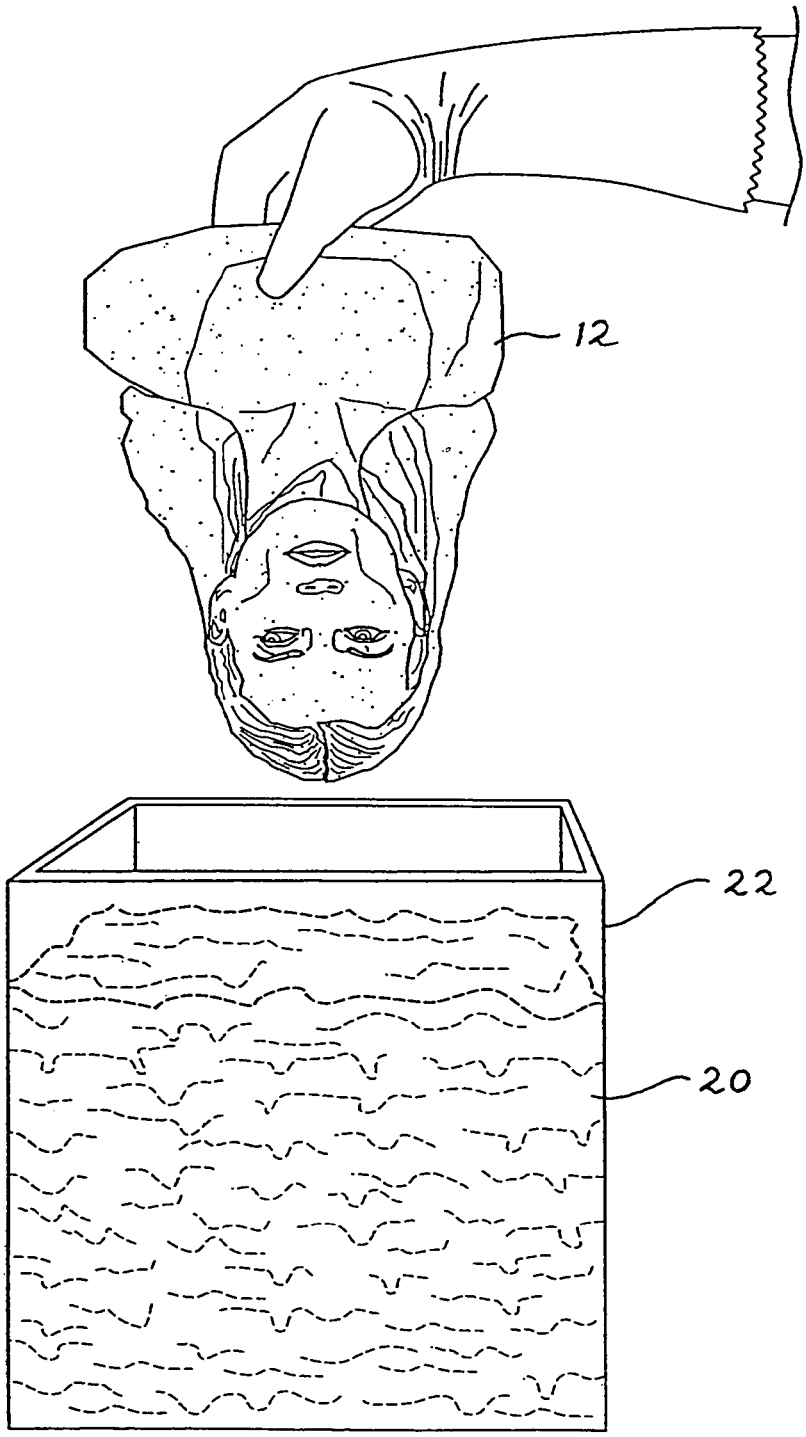
FIG. 3 shows a substrate and the composition.

The present invention is directed to a slurry composition for casting and a method of use thereof. The investment casting process begins with the substrate 12 shown in FIG. 1. The substrate 12 is a model of the final object to be produced, and is typically made of wax or other easily meltable material. The substrate can be made using any conventional process. The present invention includes a slurry that can be applied to a substrate. The slurry composition may be applied by a variety of methods, including, for example and without limitation, dipping the substrate into the slurry and spraying or brushing on the slurry. FIG. 2 illustrates the coating of the substrate 12 with the slurry composition. The composition 18 may applied with a brush 16, for example. The composition 14 is applied to coat the entire surface of the substrate 12 to the desired thickness. The desired thickness of the cast will depend on a variety of factors, including the size of the substrate, the temperature of the final casting, and the materials used in the final casting. A typical thickness for the wall of the mold is 0.25", but thinner wall thicknesses are possible with the composition.

Alternatively, the substrate may be dipped into the slurry composition, as shown in FIGS. 3 and 4. A slurry 20 of the composition is held in a vat 22 or other suitable container. The substrate 12 is dipped into the vat 22. The slurry 24 adheres to the surface of the substrate 12. FIG. 5 shows the composition 24 completely covering the substrate. The composition is then allowed to dry in order to form a mold. The set time of the composition depends on the amount of setting agent and can range from about 15 minutes to about ten hours.

Following a standard investment casting process, which is well known to those skilled in the art, the mold is then heated to melt out the substrate. Before forming the casting, the mold may either be allowed to cool, or used while still hot. The mold may then be filled with liquid metal to form castings of the desired design.

The composition of the invention may include about 45-80% by weight of an alumina component, preferably about 50-65% by weight of the alumina component. The alumina component preferably has an average particle diameter of about 100 micrometers to about 3 mm, and is preferably selected from brown fused alumina, white fused alumina, tabular alumina, and mixtures thereof. In one embodiment, the alumina component has the following size distribution: particles of screen size 6×14 (1.1 to 3.0 mm) are present at about 0-10% by weight of the composition, particles of screen size 14×70 (0.2 to 1.1 mm) are present at about 40-60% by weight, and alumina particles of screen size −70 (0.150 mm) are present at about 2-10% by weight.

The composition of the invention may also include about 2-12% by weight calcined alumina having an average particle diameter of about 0.2-70 microns. The calcined alumina is believed to react with the colloidal silica binder to form a sediment phase which causes further improved binding characteristics, especially at higher temperatures.

The composition of the invention includes about 10-30% by weight silicon carbide. Preferably, the slurry composition includes about 15-25% by weight silicon carbide. The silicon carbide should have an average particle diameter between about 30 micrometers and about 3.5 millimeters, in order to promote flow of the composition during application and improve the strength of the resulting shell. A wide distribution of particle sizes facilitates flow and workability of the composition, as well as enhancing the strength of the shell.

The composition of the invention also includes about 10-50% by weight of an aqueous colloidal silica binder, and preferably includes about 15-30% by weight of this binder. The binder should include about 10-70% by weight colloidal silica in water, preferably about 30-50% by weight colloidal silica in water. The colloidal silica should have an average silica particle diameter of about 4-100 nanometers, preferably about 8-20 nanometers.

The colloidal silica binder serves two important purposes. During application of the composition, the aqueous colloidal silica imparts excellent flow and suspension properties. After the slurry composition has been formed and dried, the colloidal silica acts as an excellent binder, thereby contributing strength and erosion resistance to the shell.

In one embodiment, the composition of the invention includes about 1 -5% by weight of fumed silica. Fumed silica improves the flow and mixing properties of the composition and also helps to prevent caking.

The composition of the invention preferably includes about 0.05-2.0% by weight of a setting agent. Examples of suitable setting agents include calcium aluminate cement, magnesium oxide, and mixtures thereof. By adding an appropriate amount of setting agent, the set time of the composition can be adjusted from under 15 minutes to over 10 hours.

In one embodiment, the composition includes about 0.05-0.5% by weight of a fiber, preferably polypropylene fiber. Examples of suitable polypropylene fiber include Herculon™, available from Hercules Inc. In a preferred embodiment, the fibers are around 2-10 mm in length and 1-5 denier in diameter.

In one embodiment, the composition of the invention includes about 0.01-1.0% by weight of a welan gum. Welan gum is a fermentation polysaccharide with excellent thermal stability and retention of viscosity at elevated temperatures. It improves the workability of the composition by improving the suspension characteristics so that the components of the composition will not separate during application. It helps to provide a uniform and stable distribution of the components of the mixture and reduces the need for multiple coats to produce a shell. Welan gum is available from Kelco-Crete®.

The slurry composition of the invention may also include about 0-10% by weight free carbon, preferably about 2-6% free carbon, having an average particle diameter of about 40 microns to about 0.5 mm. Typically, the carbon is in the form of pitch, which is a mixture of carbon and volatile organic compounds. The slurry composition of the invention preferably includes about 0.05-5% by weight of petroleum pitch.

EXAMPLE 1

An investment casting composition was prepared by mixing the following components together in the stated quantities.

| Component | Size | % By Weight |
|---|---|---|
| Alumina | 6 × 14 | 4 |
| Alumina | 14 × 70 | 46 |
| Alumina | −70 | 6 |
| Calcined alumina | 45 microns | 4 |
| silicon carbide | 75 microns | 16.6 |
| fumed silica | | 2 |
| petroleum pitch | | 1 |
| welan gum | | 0.1 |
| magnesia | | 0.2 |
| polypropylene fiber | | 0.1 |
| colloidal silica binder | | 20 |

The resulting casting composition had excellent flow properties and was applied to substrates by both the brushing and dipping methods. The composition had a set time between three and four hours. The slurry composition yielded molds with excellent density, porosity and strength, and acceptable casts were made from the molds.

The embodiments described above and shown herein are illustrative and not restrictive. The scope of the invention is indicated by the claims rather than by the foregoing description and attached drawings. The invention may be embodied in other specific forms without departing from the spirit of the invention. Accordingly, these and any other changes which come within the scope of the claims are intended to be embraced therein.

What is claimed is:

1. A slurry composition for a mold comprising about 45% to about 80% by weight alumina, wherein the alumina component comprises particles of between about 1.1 to about 3.0 mm in diameter at about 0% to about 10% by weight of the composition, particles of between about 0.2 to about 1.1 mm in diameter at about 40% to about 60% by weight of the composition, and particles of about 0.150 mm in diameter at about 2% to about 10% by weight of the composition;

about 10% to about 30% by weight silicon carbide;

about 10% to about 50% by weight colloidal silica binder;

about 0.01% to about 1% by weight welan gum;

and a setting agent.

2. The composition of claim 1, wherein the silicon carbide has an average particle diameter of about 30 micrometers to about 3.5 millimeters.

3. The composition of claim 1, wherein the silicon carbide is present at about 12% to about 25% by weight.

4. The composition of claim 1, wherein the alumina component is present at about 50% to about 65% by weight.

5. The composition of claim 1, wherein the alumina component comprises a material selected from the group consisting of brown fused alumina, white fused alumina, tabular alumina, calcined alumina, and mixtures thereof.

6. The composition of claim 1, further comprising about 2% to about 6% by weight free carbon.

7. The composition of claim 6, wherein the free carbon is present in the form of pitch.

8. The composition of claim 1, further comprising 2% to about 5% by weight fumed silica.

9. The composition of claim 1, wherein the setting agent is present at about 0.05% to about 2% by weight.

10. The composition of claim 9, wherein the setting agent is magnesia.

11. The composition of claim 1, further comprising 0.05% to about 0.5% by weight polypropylene fiber.

12. A casting method, the method comprising:
providing a meltable patterned substrate;
coating the substrate with a slurry composition;
allowing the slurry composition to set and form a mold; and
removing the substrate from the mold;
wherein the slurry composition comprises
about 45% to about 80% by weight alumina;
about 10% to about 30% by weight silicon carbide;
about 10% to about 50% by weight colloidal silica;
about 0.01% to about 1% by weight welan gum; and
a setting agent.

13. The method of claim 12, wherein the substrate is coated with the slurry composition by dipping the substrate into the slurry composition.

14. The method of claim 12, wherein the substrate is coated with the slurry composition by spraying the slurry composition onto the substrate.

15. The method of claim 12, wherein the substrate is coated with the slurry composition by brushing the slurry composition onto the substrate.

16. The method of claim 12, wherein the silicon carbide is present at about 15% to about 25% by weight of the slurry composition.

17. The method of claim 12, wherein the alumina component is present at about 50% to about 65% by weight of the slurry composition.

18. The method of claim 12, wherein the slurry composition further comprises about 2% to about 6% by weight free carbon.

19. The method of claim 12, wherein the slurry composition further comprises fumed silica at about 1% to about 5% by weight of the slurry composition.

20. The method of claim 12, wherein the slurry composition further comprises about 0.05% to about 2% by weight setting agent.

21. The method of claim 12, wherein the slurry composition further comprises 0.05% to about 0.5% by weight polypropylene fiber.

22. The method of claim 12, wherein the alumina component comprises particles of between about 1.1 to about 3.0 mm in diameter at about 0% to about 10% by weight of the composition, particles of between about 0.2 to about 1.1 mm in diameter at about 40% to about 60% by weight of the composition, and particles of about 0.150 mm in diameter at about 2% to about 10% by weight of the composition.

23. A casting method, the method comprising:
providing a meltable patterned substrate;
coating the substrate with a slurry composition;
allowing the slurry composition to form a mold; and
removing the substrate from the mold;
wherein the slurry composition comprises
about 45% to about 65% by weight alumina, wherein the alumina component comprises particles of between about 1.1 to about 3.0 mm in diameter at about 0% to about 10% by weight of the composition, particles of between about 0.2 to about 1.1 mm in diameter at about 40% to about 60% by weight of the composition, and particles of about 0.150 mm in diameter at about 2% to about 10% by weight of the composition;
about 10% to about 30% by weight silicon carbide;
about 10% to about 50% by weight colloidal silica;
about 0.01% to about 1% by weight welan gum; and
a setting agent.

24. A casting method, the method comprising:
providing a meltable patterned substrate;
coating the substrate with a slurry composition;
allowing the slurry composition to form a mold; and
removing the substrate from the mold;
wherein the slurry composition comprises
about 45% to about 65% by weight alumina, wherein the alumina component comprises particles of between about 1.1 to about 3.0 mm in diameter at about 0% to about 10% by weight of the composition, particles of between about 0.2 to about 1.1 mm in diameter at about 40% to about 60% by weight of the composition, and particles of about 0.150 mm in diameter at about 2% to about 10% by weight of the composition;
about 10% to about 30% by weight silicon carbide;
about 10% to about 50% by weight colloidal silica;
about 0.01% to about 1% by weight welan gum; and
providing a setting agent in the slurry composition, such that a set time can be controlled by varying the amount of setting agent.

25. The method of claim 24, wherein the set time is between 15 minutes and 10 hours.

26. The method of claim 24, wherein the setting agent is magnesia.

27. The method of claim 24, wherein the substrate is coated with no more than three coats of the slurry composition.

28. The method of claim 24, wherein the substrate is coated with no more than two coats of the slurry composition.

29. The method of claim 24, wherein the substrate is coated with a single coat of the slurry composition.

30. A slurry composition for a mold comprising about 45% to about 80% by weight alumina, wherein the alumina component comprises particles of between about 1.1 to about 3.0 mm in diameter at about 0% to about 10% by weight of the composition, particles of between about 0.2 to about 1.1 mm in diameter at about 40% to about 60% by weight of the composition, and particles of about 0.150 mm in diameter at about 2% to about 10% by weight of the composition;
about 10% to about 30% by weight silicon carbide;
about 10% to about 50% by weight colloidal silica binder;
about 0.01% to about 1% by weight polysaccharide gum; and
a setting agent.

31. The composition of claim 30, wherein the silicon carbide is present at about 12% to about 25% by weight.

32. The composition of claim 30, wherein the alumina component is present at about 50% to about 65% by weight.

33. The composition of claim 30, further comprising 0.05% to about 0.5% by weight polypropylene fiber.

34. A casting method, the method comprising:

providing a meltable patterned substrate;

coating the substrate with a slurry composition;

allowing the slurry composition to form a mold; and removing the substrate from the mold;

wherein the slurry composition comprises about 45% to about 65% by weight alumina, wherein the alumina component comprises particles of between about 1.1 to about 3.0 mm in diameter at about 0% to about 10% by weight of the composition, particles of between about 0.2 to about 1.1 mm in diameter at about 40% to about 60% by weight of the composition, and particles of about 0.150 mm in diameter at about 2% to about 10% by weight of the composition;

about 10% to about 30% by weight silicon carbide;

about 10% to about 50% by weight colloidal silica; and about 0.01% to about 1% by weight polysaccharide gum; and a setting agent.

35. A casting method, the method comprising:

providing a meltable patterned substrate;

coating the substrate with a slurry composition;

allowing the slurry composition to form a mold; and removing the substrate from the mold;

wherein the slurry composition comprises about 45% to about 65% by weight alumina, wherein the alumina component comprises particles of between about 1.1 to about 3.0 mm in diameter at about 0% to about 10% by weight of the composition, particles of between about 0.2 to about 1.1 mm in diameter at about 40% to about 60% by weight of the composition, and particles of about 0.150 mm in diameter at about 2% to about 10% by weight of the composition;

about 10% to about 30% by weight silicon carbide;

about 10% to about 50% by weight colloidal silica;

about 0.01% to about 1% by weight polysaccharide gum; and a setting agent in the slurry composition, such that a set time can be controlled by varying the amount of setting agent.

36. The method of claim 35, wherein the substrate is coated with a single coat of the slurry composition.

37. The method of claim 35, wherein the slurry composition further comprises 0.05% to about 0.5% by weight polypropylene fiber.

* * * * *